US005702099A

United States Patent [19]

Köhn

[11] Patent Number: 5,702,099

[45] Date of Patent: Dec. 30, 1997

[54] ARRANGEMENT FOR SEPARATING FLAT STACKED OBJECTS

[75] Inventor: Uwe Köhn, Osnabrück, Germany

[73] Assignee: Windmöller & Hölscher, Lengerich/Westf., Germany

[21] Appl. No.: 677,308

[22] Filed: Jul. 9, 1996

[30] Foreign Application Priority Data

Jul. 11, 1995 [DE] Germany ..... 195 25 236.5
Oct. 26, 1995 [DE] Germany ..... 195 39 933.1

[51] Int. Cl.[6] ..... B65H 3/08

[52] U.S. Cl. ..... 271/101; 271/3.07; 414/788.4; 414/797.7

[58] Field of Search ..... 271/121, 131, 271/137, 138, 165, 3.05, 3.07, 99, 100, 101; 414/788.4

[56] References Cited

U.S. PATENT DOCUMENTS

| | | | |
|---|---|---|---|
| 3,797,677 | 3/1974 | Gracher et al. | 414/797.7 X |
| 5,106,070 | 4/1992 | Reist | 271/101 X |
| 5,556,254 | 9/1996 | Darcy et al. | 414/797.7 X |

FOREIGN PATENT DOCUMENTS

| | | |
|---|---|---|
| 1536489 | 12/1969 | Germany . |
| 3208425 | 9/1983 | Germany . |
| 3214342 | 10/1983 | Germany . |
| 2732591 | 1/1986 | Germany . |
| 4040831 | 6/1992 | Germany . |
| 637 087 | 7/1983 | Switzerland . |

*Primary Examiner*—Janice L. Krizek
*Attorney, Agent, or Firm*—Keck, Mahin & Cate

[57] ABSTRACT

An arrangement for separating flat stacked objects is composed of a stacking hopper, the base of which supports the stack and is composed of rolls. The rolls pass through at intervals and roll against the respective bottommost workpiece. The rolls are provided in a traveling series and are driven in a rotating manner. A conveyor belt for transporting material away is arranged below the series of rolls. The respective bottommost workpiece successively peeled off the stack by each roll passage is placed onto the conveyor belt. In sync with the passage of the rolls, suction boxes grip and pull down a lateral edge of the respective bottommost workpiece between two rolls in such a way that the roll that arrives below the stack still supports the stack through the workpiece. The subsequent roll passes between the workpiece and the workpiece located above the previous workpiece and causes a reliable separation of the respective bottommost piece from the stack. In order to transport separated workpieces away such that the lateral edges of these pieces are parallel to the direction of transport of the conveyor belt for conveying material, the stacking hopper is arranged between the upper belt and lower belt of the traveling series of rolls in such a way that the lower belt forms the base which supports the stack in the hopper. The conveyor belt for transporting material away is arranged in parallel with the lower belt of the traveling series of rolls and transports in the direction opposite that of the lower belt of the traveling series of rolls.

6 Claims, 4 Drawing Sheets

ARRANGEMENT FOR SEPARATING FLAT STACKED OBJECTS

BACKGROUND OF THE INVENTION

1. Field of the Invention

This invention pertains to an arrangement for separating flat stacked objects, such as stacked tubular pieces to be processed into bags, with a stacking hopper. The base of the stacking hopper supports the stack and is composed of rolls which pass through at intervals and roll against the respective bottommost workpiece. A traveling series of rolls is driven in a rotating manner. A conveyor belt for transporting material away is arranged below the series of rolls. The respective bottommost workpiece that has been successively peeled off the stack by each passage of a roll is placed on the conveyor belt. Suction boxes, in sync with the passage of the rolls, grip and pull down the lateral edge of the respective bottommost workpiece between two rolls in such a way that the roll arriving below the stack still supports the stack through the workpiece. The subsequent roll passes between the workpiece and the workpiece located above it, causing a reliable separation of the respective bottommost workpiece from the stack.

2. Description of Related Art

Rotary feeders, such as those disclosed in DE-OS 1,536,489, DE-OS 3,208,425 and DE-OS 3,214,342, are known for separating flat stacked workpieces. The rotary feeders are composed of suction rolls pivoted in rotating drums, which suction rolls, when passing below a stack which is supported by the drum, attach themselves by suction to the leading edge of the bottommost workpiece of the stack. The suction rolls pull off and deliver the workpieces separated in this manner to a conveyor belt for conveying material. However, the separating of packages of workpieces with this type of rotary feeder is a problem at high separating speeds, since the package supported on the rotating drum of the rotary feeder may begin to vibrate in such a way that it is no longer guaranteed that the suction roll will reliably take hold of the respective bottommost workpiece of the stack.

Flat stacked workpieces can be separated at a high speed with an arrangement of the aforementioned type which is known from DE-2,732,591 C2. However, with this known arrangement, laying separated rectangular objects on the conveyor for transporting material away in such a way that the lateral edges of the objects are aligned parallel to the direction of transport is still a problem. This is because the lateral edge, or a section of this lateral edge, which is drawn off by the suction box or suction boxes, encounters the conveyor for transporting material away at a point in time at which a section of the workpiece is still being held against the underside of the stack. As the workpiece that has been peeled off is laid on the conveyor for conveying material, the workpiece can shift in such a way that it cannot be laid down with aligned edges. It is questionable whether laying workpieces down with aligned edges on the conveyor for conveying material can be realized if the conveyor has a path which is acute with respect to the traveling series of rolls in the manner shown in DE-2,732,591 C2.

SUMMARY OF THE INVENTION

Therefore, the object of this invention is to create an arrangement, of the aforementioned type, for which separated rectangular workpieces can be transported away and in which the lateral edges of the same are parallel to the direction of transport of the conveyor for conveying material.

This problem is solved in accordance with the invention, by using an arrangement in which the stacking hopper is arranged between the upper belt and lower belt of the traveling series of rolls in such a way that the lower belt forms the base supporting the stack within the hopper and the conveyor belt for transporting material away is arranged parallel to the lower belt of the traveling series of rolls and transports in a direction of transport opposite the traveling series of rolls.

For the separating arrangement known from DE-2,732,591 C2, there is the problem of laying down the rectangular workpieces successively peeled from the underside of the stacking hopper such that the edges of the former are aligned, that is, with lateral edges which are parallel to the direction of transport of the conveyor belt for transporting material away, such that separated workpieces can be delivered in the correct position to a processing machine or conveyor belt for conveying material. This difficulty is avoided in accordance with the invention by arranging the stacking hopper from which workpieces are separated above the lower belt of the traveling series of rolls in such a way that separated workpieces are laid down on the conveyor belt for transporting material away parallel to each other and, hence, without twisting. A shifting or twisting of separated workpieces as they are laid down on the conveyor belt for transporting away material is eliminated by arranging the conveyor belt for transporting material away parallel to the lower belt of the traveling series of rolls which separates workpieces from the stacking hopper.

For the separating arrangement in accordance with the invention, the upper belt of the traveling series of rolls must be arranged at such a height above the lower belt that the stacking hopper can be arranged between both belts in such a way that the stacking hopper can be loaded with stacks to be separated either by hand, free of danger, or else with a feeding conveyor, e.g., a conveyor made up of small rollers.

Should it not be possible, or desirable, to arrange the stacking hopper holding the stack to be separated between the upper and lower belts of the traveling series of rolls, an upper stacking hopper can be arranged above the upper belt of the traveling series of rolls. From the stacking hopper, the rolls of the upper belt successively peel off the respective bottommost workpiece and lay it in the lower hopper which forms an intermediate stacking hopper. Separated workpieces are then drawn off from this lower intermediate stacking hopper by the rolls of the lower belt of the traveling series of rolls in the described manner, and laid on the conveyor belt for transporting material away, which conveyor belt has a parallel path.

In accordance with an inventive further development, a second conveyor belt for conveying material is provided, which moves at a higher speed. The second conveyor belt is attached to the first conveyor belt for transporting material away. A pressure roll, which works in conjunction with the feeder-side deflection roll of the conveyor belt for conveying material, can be lowered onto the latter and is controlled in such a way that workpieces are drawn off from the first conveyor belt at times which guarantee a precisely timed arrival at pertinent processing stations. The workpieces arrive in the correct positions and in coordination with the machine cycle of pertinent processing devices.

A control system can be provided in order to control the pressure roll. The control system determines the times for lowering the pressure roll from the signals of a sensor for detecting the leading edge of the subsequent workpiece and from the signals of a signal transmitter which indicates the correct position of this workpiece on the conveyor belt for conveying material.

The signal transmitter can be a sensor for detecting the angle of the feeder-side deflection roll of the conveyor belt for conveying material and for generating signals corresponding to these rotating markers distributed at equal intervals around the periphery.

BRIEF DESCRIPTION OF THE DRAWINGS

An embodiment of the invention is more closely explained in the following with reference to the drawing figures.

DESCRIPTION OF THE PREFERRED EMBODIMENT

Figure 1:
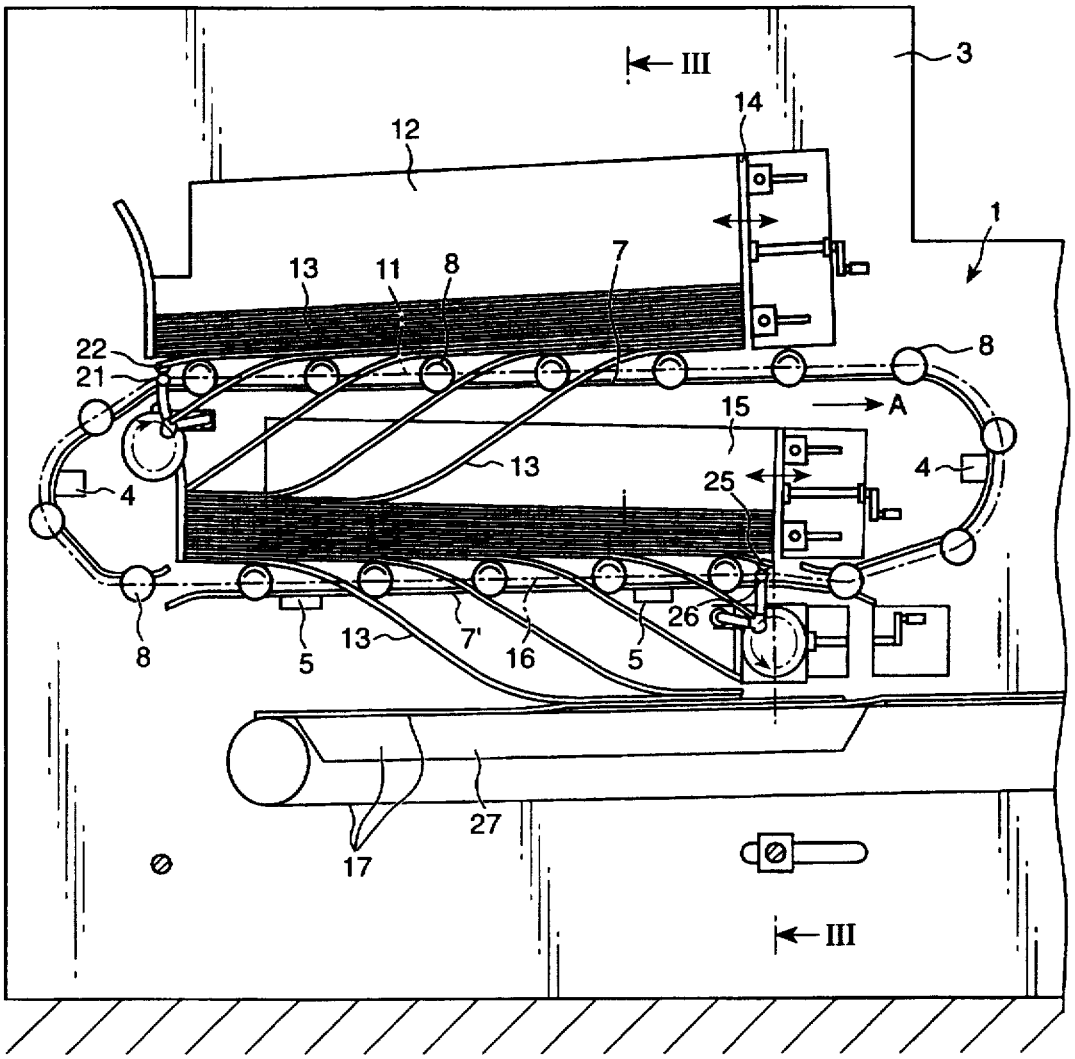
FIG. 1 shows a section of the separating arrangement with a feeder stacking hopper and intermediate stacking hopper along line I—I in FIG. 3.
Figure 2:
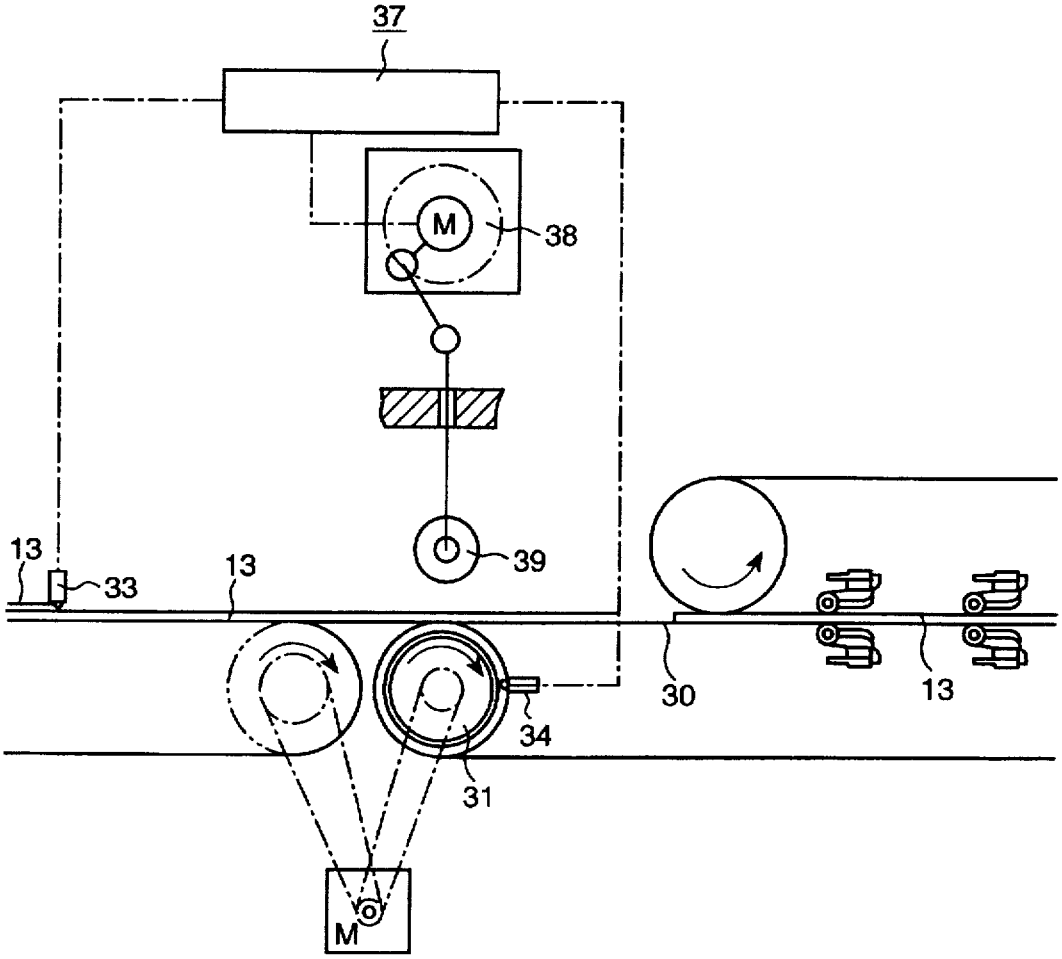
FIG. 2 shows the right section of the conveyor belt for transporting material away, which has a path below the lower belt of the series of rolls, with a conveyor belt for conveying on material attached to the former.
Figure 3:
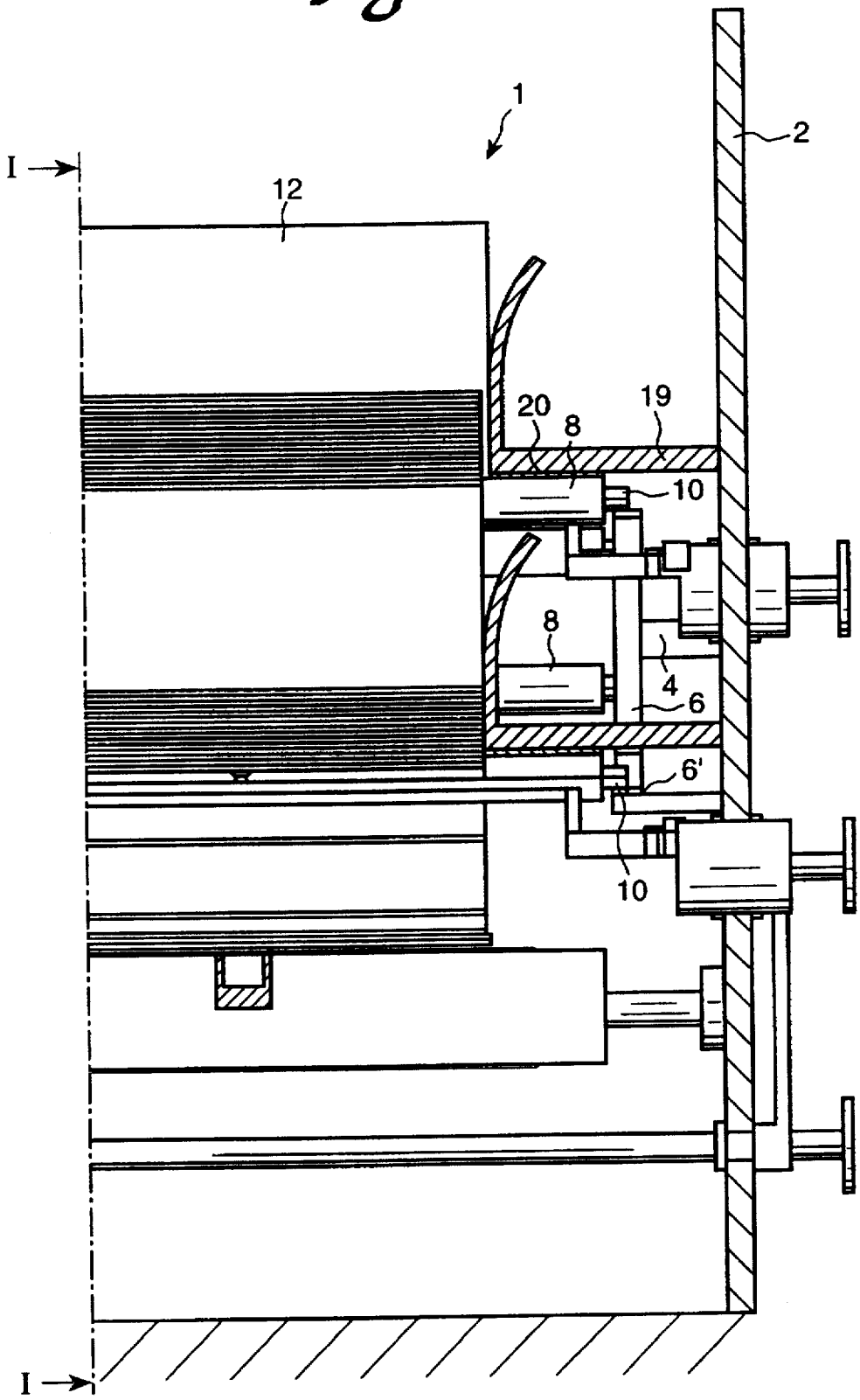
FIG. 3 shows a section of the separating arrangement along line III—III in FIG. 1.

A separating arrangement (1) is composed of a machine frame with lateral parts (2,3), to the inner sides of which are mounted, by retainers (4,5), guides (6,7) composed of profiles for rolls (8) which rotate on the latter. The two guides (6,7) arranged in parallel with each other are respectively composed of upper and lower sections which are in parallel with each other and are attached to each other by sections of an approximately semicircular shape. In the embodiment represented, lower guide sections (6',7') are separated from upper guide sections (6,7) with semicircular attaching sections so that the rolls can be changed from the outer side to the inner side of the guide sections (6',7') and also be supported by the length of the guide sections (6',7') forming the lower belt of the series of rolls.

The ends of the rolls (8), which are guided on guides (6,7,6',7') and are arranged to be parallel and equidistant with respect to each other, are mounted with endless chains or pulling elements which move in guides, not shown, and are driven by drives, not shown. The rolls (8) are composed of cylindrical pipe lengths that can freely pivot on shafts, the shaft ends (10) of which are mounted to chains or pulling elements which move the same by guides (6,7,6',7').

The upper belt (11) of rolls (8), which rotate by means of guides on endless chains or pulling means, forms a traveling series of rolls, above which a case (12) which forms a stacking hopper is retained on the lateral parts (2,3) and serves to accommodate stacked tubular paper pieces (13) which, after being separated, are made into paper sacks in pertinent processing stations. The case (12) has four lateral walls, of which at least one lateral wall (14) can be adjusted, in the direction of the double arrow, for different tubular piece formats by a manual spindle drive.

The base of the stacking case (12) is formed by the upper belt (11) of the traveling series of rolls.

An intermediate stacking hopper (15) is arranged below the upper belt (11) of the traveling series of rolls. The base of the intermediate stacking hopper is formed by the lower belt (16) of the traveling series of rolls. The intermediate stacking hopper (15) also has four lateral walls, of which at least one lateral wall can be adjusted to different tubular piece formats.

A suction conveyor belt (17) is arranged below the lower belt (16) of the traveling series of rolls, which suction conveyor belt has a path parallel to the lower belt (16) of the traveling series and transports away workpieces (13) separated from the intermediate stacking hopper (15) and laid down on the former like scales.

The upper belt (11) of the traveling series of rolls moves in the direction of Arrow A under the stacking case (12) in which a stack to be separated is loaded or fed. The undersides of plate-shaped plates (19), which support the opposing lateral walls of the stacking case, are provided with a friction-increasing covering (20) on which are pressed the lateral end regions of the freely rotating roll sleeves, which are composed of lengths of pipe, of the rolls (8) as these pass under the case, such that they are set into rotation while supporting, in the manner shown in FIG. 1, the respective bottommost tubular piece stacked in the case (12).

After the arrival of each roll (8) below the case (12), two suction boxes (21), which can be raised and lowered and are arranged laterally on the left end region of the case, as shown evident in FIG. 1, take hold of the lower leading lateral edge (22) of the bottommost stacked tubular piece (13), which in the representation shown in FIG. 1 is located to the left in the upper case (12), and pull the same behind the roll (8) moving just at that point and in front of and below the subsequent roll (8), such that the subsequent roll (8) arrives in the wedge-shaped gap between the leading edge, which has been pulled down, of the tubular piece and the end region, exposed by this means, of the next tubular piece (13). The next tubular piece is thereupon pulled down in a corresponding manner by means of the suction box, which can be raised and lowered in sync.

Figure 4:
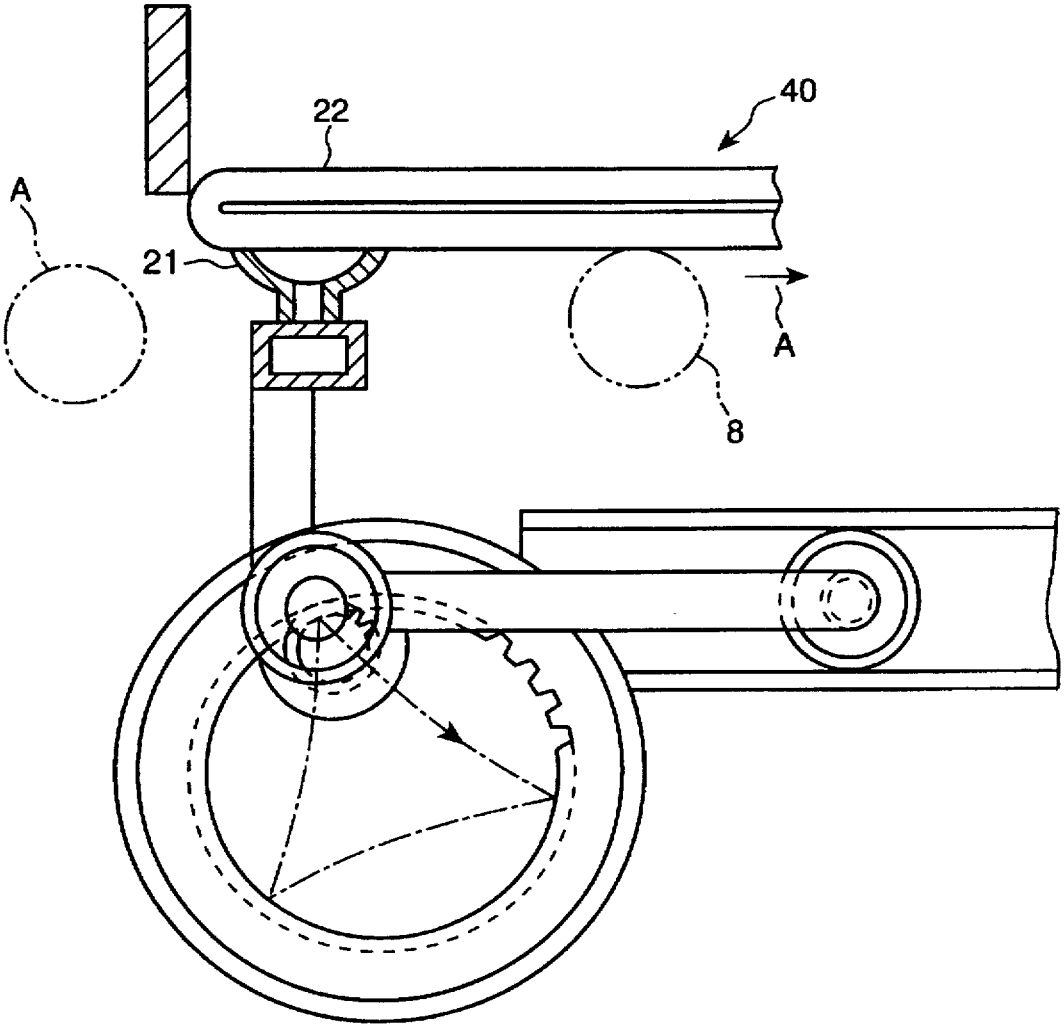
FIG. 4 is a diagrammatic representation of a section of the suction box with a drive mechanism, which suction box attaches itself by suction to the lower leading lateral edge of the respective workpiece to be separated from the stack in the feeder stacking hopper.

The drive of the two suction boxes (21), which can be raised and lowered in sync with the passage of the rolls (8), is schematically shown in FIG. 4.

The way in which the respective bottommost workpiece is peeled from the stacking case (12) and the driving gear of the suction box (21), which can be raised and lowered, corresponds to the representation and description in DE-2, 732,591 C2, to which reference is made for a more detailed representation. Yet, in contrast to the arrangement described in this publication, two suction boxes (21) are provided in pairs for the separating arrangement in accordance with the invention, which respective suction boxes simultaneously act on the end regions, which lie opposite each other, of the trailing edges of the workpieces (13) to be separated. The suction boxes (21) are, moreover, connected, in a manner also described in DE-2,732,591 C2, to suction air sources which provide the suction boxes (21) with suction air in sync.

Tubular pieces (13) that are successively separated from the bottom of the stack, which is retained in the case (12), fall, after being drawn off as shown in FIG. 1, into the intermediate case (15) arranged below the case (12) and above the lower belt (16) of the traveling series of rolls. From here, the respective bottommost workpiece is peeled off by a passage of rolls (8) of the traveling series of rolls and laid on the conveyor belt for transporting material away (17) in a superimposed formation in the manner of scales, where the trailing edges (25) of the workpieces, viewed in the direction of passage of the rolls, are respectively drawn down between two circulating rolls (8) by the suction boxes (26) arranged in painE. The stack, which isommost workpiece (13) is peeled from the stack, which is stacked in the intermediate stacking case (15), in the same manner as described with the aid of the stack which is stacked in case (12).

The conveyor belt for transporting material away (17) is a suction conveyor belt, the conveyor belts of which, provided with tracks of punched holes and which tun parallel to each other, pass over suction boxes (27).

In the embodiment represented, the separating arrangement (1) precedes a so-called bottom folder of a sack manufacturing machine in which the bottoms, e.g., cross bottoms, are formed on the sides, which are provided with cut edges, of tubular pieces (13). So that separated tubular pieces, which are conveyed in a transverse manner, can be fabricated without trouble, it is necessary that the tubular pieces be delivered from the suction conveyor belt (17) in a properly registered manner and, hence, to the conveyor belt for conveying material (30), which forms the conveyor for feeding the bottom folder, in such a way that the workpieces (13) are taken over by the latter, in the correct position, at times which are coordinated with the machine cycle of pertinent processing stations of the bottom folder, such that the arrival of the workpieces in pertinent fabricating stations is guaranteed in a precisely synchronized manner and the correct position.

The front deflection roll (31) of the conveyor belt for conveying material (30) is driven at a high speed by a geared motor (M), such that the conveyor belt for conveying material (30) tums at a higher speed than the suction conveyor belt (17). In order to guarantee a taking over of the workpieces supplied by the suction conveyor belt (17), which taking over is in a correct position and is precisely timed, the suction belt conveyor (17) delivers the workpieces in such a way that the workpieces ascend on or over the drive roll (31) of the conveyor (30) at a time during which the respective workpiece (13) is still being held by the suction box (27). The position of the respective leading edge of the workpiece (13) subsequently transported is detected by a sensor (33). A sensor (34),such as an incremental transmitter, scans the teeth or other grid markers which are connected to the drive roll (31) of the conveyor (30). The sensor (34) generates signals which indicate the precisely timed passage of a point through a consequent processing arrangement. From the signals of the sensors (33,34), the computer (37) generates a signal for the drive (38) of a pressure roll (39), which can be raised or lowered, that is lowered to the drive roll (31) at the correct time, in sync with a pertinent processing machine, consequently causing a frictional connection of the workpiece (13) with the conveyor belt for conveying material (30), such that each workpiece (13) is taken over from the conveyor belt (17) in the correct position and at the precise time.

In pertinent sack machinery, the tubular pieces (13) can be provided with cross bottoms or bottoms that have been folded over, which are formed onto so-called graded tubular pieces.

FIG. 4 represents a graded tubular piece (40), the walls of which are of a three-ply configuration.

In order to avoid drawing off of only the lower wall of the tubular piece from the stacking hopper, the suction boxes (21) of the pair of suction boxes grip the lateral edges at which the individual plies of the upper side and lower side of the tubular piece are connected.

What is claimed is:

1. An arrangement for separating flat tubular pieces to be processed into bags comprising:

a stacking hopper having a base which supports a stack of the tubular pieces and is composed of rolls which pass through the hopper at intervals and roll against a respective bottommost workpiece, the rolls defining a series of rolls traveling on upper and lower belts, the rolls of which are driven in a rotating manner, a conveyor belt for transporting material away arranged below the series of rolls, the respective bottommost workpiece being placed onto the conveyor belt when successively peeled off the stack by each roll passage, and suction boxes which, in sync with passage of the rolls, grip and pull down a lateral edge of the respective bottommost workpiece between two rolls in such a way that a roll arriving below the stack still supports the stack through the respective bottommost workpiece and the subsequent roll passes between the respective bottommost workpiece and a workpiece located above the respective bottommost workpiece, causing a reliable separation of the respective bottommost workpiece from the stack, characterized in that the stacking hopper is arranged between said upper and said lower belt of the series of rolls so that the lower belt forms the base which supports the stack and the conveyor belt for transporting material away is arranged in parallel with the lower belt of the series of rolls and transports the workpieces away from the series of rolls.

2. The arrangement defined by claim 1, and further comprising an upper hopper arranged above the upper belt of the traveling series of rolls, rolls of the upper belt successively peeling off the respective bottommost workpiece in the upper hopper and laying it in the stacking hopper.

3. The arrangement defined by claim 1, and further comprising a second conveyor belt for conveying material, which turns at a higher speed than the conveyor belt for transporting material away, adjoining the conveyor belt for transporting material away.

4. The arrangement defined by claim 1, wherein the conveyor belt includes a feeder-side deflection roll, and further comprising a pressure roll which can be lowered to the feeder side deflection roll, and which works in conjunction with the deflection roll, and is controlled in such a way that workpieces are drawn off from the conveyor belt at times which guarantee arrival in pertinent processing stations in correct positions and coordinated with a machine cycle of pertinent processing machines.

5. The arrangement defined by claim 4, and further comprising a control system provided to control the pressure roll, a sensor for detecting a leading edge of a subsequent workpiece, and a signal transmitter which indicates a correct position of the subsequent workpiece on the conveyor belt, said control system determining a time for lowering the pressure roll from signals from the sensor and the signal transmitter.

6. The arrangement defined by claim 5, characterized in that the signal transmitter is a sensor for detecting an angle of the feeder-side deflection roll and generating signals corresponding to rotating markers distributed at equal intervals around a periphery thereof.

* * * * *